United States Patent [19]

Thursby

[11] 4,177,092

[45] Dec. 4, 1979

[54] DIFFUSING AN ELEMENT INTO A METAL

[75] Inventor: Graham J. Thursby, Whitchurch, Wales

[73] Assignee: National Research Development Corporation, London, England

[21] Appl. No.: 870,645

[22] Filed: Jan. 19, 1978

[30] Foreign Application Priority Data

Jan. 31, 1977 [GB] United Kingdom ..... 03786/77

[51] Int. Cl.[2] ..... C21D 1/78

[52] U.S. Cl. ..... 148/113; 148/13.1; 148/14; 148/16; 148/18; 148/20.3; 148/20.6; 148/27; 148/28; 148/122; 427/127

[58] Field of Search ..... 148/113, 122, 14, 13.1, 148/16, 18, 20.3, 20.6, 27, 28; 427/127

[56] References Cited

U.S. PATENT DOCUMENTS

| | | | |
|---|---|---|---|
| 3,583,887 | 6/1971 | Steger et al. | 148/113 |
| 4,073,668 | 2/1978 | Wieland et al. | 148/113 |

FOREIGN PATENT DOCUMENTS

| | | |
|---|---|---|
| 1357214 | 6/1974 | United Kingdom . |
| 1390526 | 4/1975 | United Kingdom . |

*Primary Examiner*—R. Dean

*Attorney, Agent, or Firm*—Oblon, Fisher, Spivak, McClelland & Maier

[57] ABSTRACT

Aluminium or silicon is diffused into iron (including silicon-iron) by applying to the iron an aqueous paste containing powdered aluminium/silicon, sodium silicate, and optionally magnesium oxide and colloidal silica, and firing it.

26 Claims, No Drawings

DIFFUSING AN ELEMENT INTO A METAL

This invention concerns diffusing an element or elements into a metal, for example to improve the magnetic or other properties.

The invention consists of diffusing an element or elements into a metal, by applying to the metal an aqueous paste comprising the element in powder form and sodium silicate, and firing the pasted metal e.g. to 680°–1100° C., for a duration adequate to achieve the required diffusion.

The paste preferably comprises from 0.1 to 6 g of the element per gram of the sodium silicate and is normally diluted with water as necessary to give a workable consistency. The powder of the element conveniently has a particle size of from 10 to 100 micrometers.

The paste may further comprise a diluent in powder form and also an antisettling agent which is preferably colloidal, preferably inorganic, and usually melting above the maximum processing temperature. The diluent may be a ceramic such as magnesium oxide (particle size not exceeding 20 microns for example). The antisettling agent may be colloidal silica. The amount of the antisettling agent per gram of the sodium silicate is preferably not more than 0.1 g.

The mass ratio of sodium silicate to (element plus any diluent) is preferably 1:2 to 2:1.

Usually, the pasted metal is dried before the firing. Drying in air at room temperature for ten minutes is frequently satisfactory. The firing itself is preferably performed in a non-oxidising environment, for example a hydrogen or nitrogen atmosphere, being conveniently performed in a constant temperature furnace.

After the firing, any residual coating on the metal may be removed. In this case, paste should be applied generously for a required amount of element intake. If the residual coating is not removed, the paste thickness and concentration will determine the amount of element intake.

Thereafter, an annealing of the metal is optional, and may be used to stress-relieve the metal or to modify the concentration gradient of the element. Such an annealing could be at 680° C. to 1100° C. and could last for ¼ to 24 hours preferably ½ to 3 hours. It is favourable to perform this anneal in a reducing atmosphere e.g. hydrogen if higher temperatures (e.g. above 850° C.) are employed. The firing and annealing may be consecutive or concurrent.

The metal may be a transition series metal such as iron, by which expression we include an iron-based alloy, which may contain up to 4% by weight silicon, such as 3% silicon-iron.

The element may be silicon. The pasted metal may in that case be fired at 800° C.–1100° C., preferably 840° C.–1040° C., for from ¼ to 6 hours.

Another possibility for the element is aluminium. In this case the pasted metal may be fired at 680° C.–950° C., e.g. 700° C. to 800° C., preferably for a duration of ¼ to 2 hours.

The annealing (with iron and silicon) is desirably such as to provide a product having an interior silicon concentration of up to 4% (e.g. 3%) affording reasonable ductility and bulk saturation magnetisation, smoothly rising to a surface silicon concentration of 5 to 7% (e.g. 6½%) affording resistance to surface eddy currents and zero magnetostriction. Alternatively, the product may have a uniform silicon concentration (e.g. of 4 to 7%).

The invention extends to the product of the diffusing set forth above, and to an electrical-appliance core consisting of a stack of these products, and to an electrical appliance, such as a transformer, having such a core.

The invention will now be described by way of example.

EXAMPLE 1

A commercially available sample of non-grain-oriented low-carbon steel strip 0.33 mm thick contained 2.7% silicon by weight. High silicon contents have been difficult to obtain because such a material would be too brittle to be rolled, even when hot. Nonetheless, in favour of a higher silicon content are that magnetostriction passes zero at 6% Si, while saturation magnetisation falls slightly and resistivity rises strongly with increasing silicon content. The total power loss of a transformer using a silicon steel passes a minimum at 6.% Si.

Returning to the example, a paste was made up consisting of 1⅓ g Si (powder of particle size 50 micrometers) in an aqueous sodium silicate solution containing 1 g sodium silicate and further water as necessary to make the paste of a workable consistency. The preferred range is ⅓ to 3 g Si per g of sodium silicate, but is also preferably less than ½ g or else is more than 1 g of the element per gram of the sodium silicate in cases where a smooth surface finish is desired. Alternatively a dilute acid could have been used, tending to neutralise and stabilise the paste. Experiments with pastes containing around ⅔ g Si per 1.5 g sodium have been found to give rise to a cratered surface in the finished product, which is undesirable for many applications.

The steel strip was cleaned and degreased to reveal bare metal on both major surfaces, and the paste was generously applied with a brush on both the surfaces. While it would be possible to apply the paste to a thickness containing just the amount of silicon required it is easier to apply a thick coating containing excess silicon and to control silicon diffusion by the time and temperature of later heating. Therefore a thick coating was applied.

The pasted steel strip was allowed to dry in air at room temperature. This took about 10 minutes.

The sample was then placed in a hydrogen-filled furnace and fired by heating at a rate of 200°C./hour up to 900° C. Temperatures much above 1080° C. might cause the steel to recrystallise, which is undesirable. Above about 1040° C., the finished product has a rather rough surface, which may be unacceptable in some applications. Below 800° C., and to some extent below 840° C., diffusion is slow.

The temperature of 900° C. was held for 1 hour. The sample was then furnace-cooled to room temperature (about 200° C./hour) and removed from the furnace. The residue of the paste coating was then rubbed off.

Investigations of the resulting finished product showed that the silicon concentration at the surface was 6% and declined to the centre of the sample, where it was 3%. Thus, thanks to this lower-silicon centre, flux penetration into the centre of the strip was good, helping to give a good flux distribution through the material, while the higher-silicon surfaces showed resistance to eddy-currents, which are mainly superficial. Power loss at 1 Tesla at 50 Hz was reduced by about 14%. A stack of these products formed into a laminated transformer core showed low noise, since there was little magnetostriction. The surface finish of the finished product was somewhat, but not excessively, rough.

EXAMPLE 2

A commercially available sample of grain-oriented low-carbon steel strip 0.33 mm thick contained 3.2% silicon by weight. This strip, as sold, had an insulative coating imparting to the steel a tensile stress reducing the effect of compressive stress which would arise in a laminated transformer core and contributing to its low power loss (0.36 W/kg at 1 Tesla at 50 Hz and 11.0 W/kg at 1 Tesla at 400 Hz). The insulative coating was removed, which incidentally was found to increase the power loss to 0.04 and 12.0 W/kg respectively.

A paste was prepared containing $1\frac{1}{3}$ g aluminium powder added to a sodium silicate solution containing 1 g sodium silicate and further including such amount of water as necessary to make the paste workable. The paste was generously applied with a brush on both surfaces, and the pasted strip was allowed to dry in air at room temperature; this took about 10 minutes. Note that no acid was used in formulating the paste. Where $1\frac{1}{3}$ g of aluminium were used, any amount from $\frac{1}{3}$ to 3 g would have been suitable.

The sample was then placed in a hydrogen-filled furnace and fired by heating up to 800° C. at a rate of 200° C./hour. The sample was then furnace-cooled to room temperature at about 200° C./hour. The sample was then removed from the furnace.

The residual coating on the sample was softened by soaking for a few minutes in concentrated hydrochloric acid and then scraped off, a relatively easy task compared with Example 1. The sample was then annealed at 950° C. for 1 hour and tested and then further annealed at 950° C. for a further 2 hours. The power losses in W/Kg exhibited at 1 Tesla were as follows:

| | 50 Hz | 400 Hz |
|---|---|---|
| 1 hour's anneal | 0.39W/kg | 10.0W/kg |
| 3 hours's anneal | 0.35W/kg | 10.6W/kg |

It is expected that if an insulative coating of the type which induces a tensile stress were re-applied to this sample, the power losses would be further diminished.

The compressive-stress sensitivity of both parts of the sample was gratifyingly low in that a compressive stress of 6 $MN/m^2$ resulted in a power loss increase of about 30%, while the same stress on the as-received commercially available sample resulted in an increase of 100%. Tensile-stress sensitivity was affected by the treatment, but only very marginally. The surface finish of the finished product was good and better than that of Example 1.

EXAMPLE 3

The starting material for this Example was the same as that used in Example 2.

A paste was prepared containing 10 g aluminium powder, 6 g of light (i.e. 15 microns particle size) magnesia powder MgO as a diluent and 2 g of colloidal silica powder as an antisettling agent, all incorporated in 25 ml of a sodium silicate solution ($1\frac{1}{2}$ g sodium silicate per ml, and further water as necessary to make the paste workable). The paste was generously applied with a brush on both surfaces of the sample strip, and allowed to dry. The silica helped to retain the magnesia and aluminium in suspension in the paste, and made the paste behave more compliantly during brushing-on.

The pasted strip was fired by being placed for 1 hour in a constant-temperature furnace maintained at 725° C. (anywhere from 680° C. to 800° C. being usable with suitable change in the time of treatment). The furnace has a nitrogen atmosphere. On removing the hot strip, after the hour, to cool, no ill effects were observed from contact of the strip with air.

The heat-treated strip was then annealed at 900° C. in hydrogen (that gas being advisable at this higher temperature) for 2 hours. Heating and cooling rates were 200° C./hour.

On testing, the following power losses were noted:

| | | 1.0T | 1.5T | 1.7T |
|---|---|---|---|---|
| Untreated | 50 Hz | 0.42 W/kg | 0.90 W/kg | — |
| Treated | 50 Hz | 0.36 W/kg | 0.77 W/kg | 1.24 W/kg |
| Untreated | 400 Hz | 12 W/kg | — | — |
| Treated | 400 Hz | 10 W/kg | — | — |

Note that residual paste was not removed from the sample at any stage. The residue contained magnesia which, as a ceramic, formed an insulating coating on the strip surface, obviating both the steps of paste removal and application of insulating coating. However, the proportion of aluminium in the paste then becomes more critical, as, desirably, no aluminium is left on the surfaces of the finished strip.

The above value of 1.24 W/kg is to be compared with a power loss of 1.25 W/kg at 50 Hz at 1.7 T in as-received grain-oriented silicon iron. The 1.24 W/kg might be further improved by a tensile-stress-inducing coating.

We claim:

1. A method of diffusing an element into a transition series metal, for the purpose of improving a property, such as a magnetic property, of said metal, comprising:

selecting said element from the group consisting of silicon and aluminum, forming an aqueous paste comprising the element in powdered form and sodium silicate in the ratio of 0.1 g to 6 g of said element per gram of sodium silicate.

applying to the metal said aqueous paste, and firing the pasted metal at a temperature from 680° C. to 1100° C. for a time period of from 15 minutes to 6 hours to produce a diffusion concentration gradient of said element into said metal smoothly varying from at least 5% at the surface of said metal to a maximum of 4% at the center of said metal.

2. The method of claim 1, wherein the paste comprises from 0.1 g to 4 g of the element per gram of the sodium silicate.

3. The method of claim 1, wherein the paste contains from 1 g to 2 g of the sodium silicate per milliliter.

4. The method of claim 1, wherein the paste further comprises an antisettling agent.

5. The method of claim 4, wherein the antisettling agent is colloidal.

6. The method of claim 5, wherein the antisettling agent is colloidal silica.

7. The method of claim 4, wherein the amount of the antisettling agent is not more than 0.1 g per gram of the sodium silicate.

8. The method of claim 1, wherein the pasted metal is dried before the firing.

9. The method of claim 1, wherein the firing is performed in a non-oxidising environment.

10. The method of claim 1, wherein the paste further comprises a diluent in powder form.

11. The method of claim 10, wherein the diluent is a ceramic.

12. The method of claim 11, wherein the diluent is magnesium oxide.

13. The method of claim 1, further comprising removing any residual coating from the metal after the firing.

14. The method of claim 13, further comprising annealing the metal after the removal of the residual coating.

15. The method of claim 1, further comprising annealing the metal after firing.

16. The method of claim 14, wherein the annealing is at 680° C. to 1100° C.

17. The method of claim 15, wherein the annealing lasts for ¼ to 24 hours.

18. The method of claim 1, wherein the metal is iron.

19. The method of claim 18, wherein the element is silicon.

20. The method of claim 19, wherein the pasted metal is fired at 800° C. to 1100° C.

21. The method of claim 20, wherein the pasted metal is fired at 840° C. to 1040° C.

22. The method of claim 18, wherein the element is aluminium.

23. The method of claim 22, wherein the pasted metal is fired at 680° C. to 950° C.

24. The method of claim 23, wherein the pasted metal is fired at 700° C. to 800° C.

25. The method of claim 23, wherein the duration of the firing is from ¼ to 2 hours.

26. The method of claim 1, wherein the powder of the element has a particle size of from 10 to 100 micrometers.

* * * * *